US006239712B1

(12) United States Patent
Hawk

(10) Patent No.: US 6,239,712 B1
(45) Date of Patent: May 29, 2001

(54) TALKING CONTAINER CLOSURE AND PACKAGE INCORPORATING SAME

(75) Inventor: Wesley S. Hawk, Perrysburg, OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 0 days.

(21) Appl. No.: 09/294,523

(22) Filed: Apr. 20, 1999

(51) Int. Cl.[7] ..... G08B 21/00

(52) U.S. Cl. ..... 340/686.1; 340/568.7; 340/573.1; 340/571; 340/692; 206/459; 206/807

(58) Field of Search ..... 340/686.1, 687, 340/686.2, 691.1, 692, 540, 573.1, 568.7, 568.1, 571; 206/459, 807; 215/307, 366

(56) References Cited

U.S. PATENT DOCUMENTS

| | | | | |
|---|---|---|---|---|
| 4,813,564 | | 3/1989 | Cooper et al. . | |
| 4,845,470 | * | 7/1989 | Boldt, Jr. | 340/540 |
| 4,847,597 | * | 7/1989 | Dobosi et al. | 340/571 |
| 4,960,206 | * | 10/1990 | Johannes | 206/459 |
| 5,099,232 | | 3/1992 | Howes . | |
| 5,439,103 | | 8/1995 | Howes . | |
| 5,575,383 | * | 11/1996 | Seeley | 206/217 |
| 5,625,347 | * | 4/1997 | MacLean et al. | 340/686 |

* cited by examiner

*Primary Examiner*—Nina Tong

(57) ABSTRACT

A closure (14) and a package (10) with the closure removably affixed to a neck of a container (12), the closure carrying an electrical element (36) for emitting an audible message or signal upon the distortion of the electrical element that results from application of a removal load to the closure. The closure is of the two-piece child resistant type having an inner closure member (18), which carries the electrical element, and the inner closure member is directly affixed to the neck of the container. The closure also has an outer closure member (20) that surrounds the inner closure member. A top panel (30) of the outer closure member has a circumferentially spaced plurality of radial ribs (28) that extend toward a top panel (34) of the inner closure member, and the top panel of the inner closure member has a like circumferential plurality of radial recesses (32) that face the top panel of the outer closure member. The ribs and recesses are normally disengaged, which prevents removal of the closure from the container upon turning of the outer closure member; however, upon application of a load to the top panel of the outer closure member, the ribs and recesses engage, which permits the closure to be removed from the container by turning the outer closure member. The application of the load to the top panel of the outer closure member distorts the electrical element and causes it to emit the audible message or signal.

11 Claims, 2 Drawing Sheets

TALKING CONTAINER CLOSURE AND PACKAGE INCORPORATING SAME

FIELD OF THE INVENTION

This invention relates to a removable closure for a glass or plastic bottle or other container and to a package comprising such a container with such a closure removably affixed thereto. More particularly, this invention relates to a closure of the foregoing type with an electrical element that emits an audible sound when the closure is distorted under load, for example, during an opening attempt, and to a package incorporating a container with such a closure removably affixed thereto.

BACKGROUND OF THE INVENTION

In the packaging of various products, such as pharmaceuticals and over the counter medicines and various household products, it is important that the consumer be given proper instructions for use of the product upon the opening of the package. Heretofore, this has been done by printing suitable instructions for use or other messages on an element of the package, either on the closure or on the container to which the closure is removably affixed, or on a package insert that is included in a carton in which the package is shipped. From time to time, however, it is desirable to reinforce such instructions or messages in an audible manner. Unfortunately, heretofore no closure or container has satisfactorily incorporated a device for emitting an audible signal upon the opening of the package incorporating such elements.

U.S. Pat. No. 4,813,564 (Cooper et al.) discloses a package that is made up of a container with a closure removably affixed to the container. An electrical element that is separate from the closure is applied to the rim at the neck of the container before the closure is applied to the neck. The electrical element continuously emits a signal as long as the package remains closed, and the presence or absence of the signal is monitored by a receiving instrument. Interruption of the signal from the package is a sign that the package has been opened, and when this opening occurs at a time other than the desired time, interruption of the signal is an indication of tampering with the package.

BRIEF DESCRIPTION OF THE INVENTION

According to the present invention there is provided a closure to be removably affixed to a neck of a bottle or other container, and to a package incorporating such a closure and container, in which the closure incorporates a normally silent electrical element that is capable of emitting an audible signal or message upon the distortion under load of the electrical element, for example, during the gripping of the closure to remove it from the container. The invention is especially applicable to closures of the child resistant type ("CRCs"), which are often used, mandatorily or voluntarily, in the packaging of pharmaceutical and over the counter medicinal products and in the packaging of various household products such as cleaning products, because of the two-piece construction that is typical of such CRCs. In such a CRC, there is provided an inner closure element that is directly secured to a finish on the neck of the associated container and an outer closure member that surrounds the inner closure member. Unscrewing of the outer closure member is effective only when teeth on the outer closure member engage teeth on the inner closure member, and this only occurs when the outer closure member is depressed or otherwise specially manipulated with respect to the inner closure member. In this arrangement, a suitable sound emitting electrical element can be positioned between a top panel of the outer closure member and a top panel of the inner closure member in the closure manufacturing plant, thus avoiding the need for an added assembly step in the packaging plant. Further, the load required to depress or otherwise manipulate the outer closure member with respect to the inner closure member to remove the closure from the associated container is more than adequate to distort the electrical element sufficiently to emit a message or other sound and exactly upon the opening of the package when such a message will be most beneficial to the consumer.

Accordingly, it is an object of the present invention to provide a closure for a container, and a package incorporating the container with the closure removably affixed thereto, in which the closure has an electrical element of a type that emits a signal or other message upon the distortion that the electrical element experiences upon the application of a removal load to the closure. More particularly, it is an object of the present invention to provide a closure, and package, of the foregoing type in which the closure is of the two-piece child resistant type.

For a further understanding of the present invention and the objects thereof, to attention is directed to the drawing and the following brief description thereof, to the detailed description of the preferred embodiment of the invention and to the appended claims.

DETAILED DESCRIPTION OF THE PREFERRED EMBODIMENT

Figure 1:
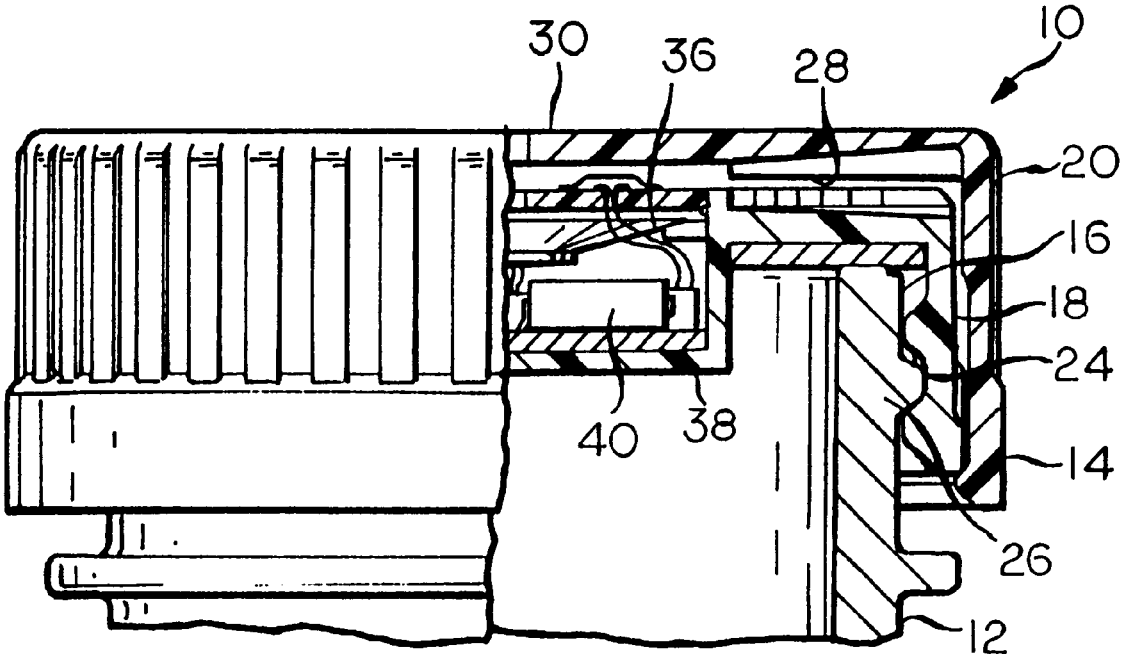
FIG. 1 is a fragmentary view, partly in cross section, of a package according to the preferred embodiment of the present invention with a closure according to the preferred embodiment of the present invention removably affixed to a finish on a neck of a container of the package.
Figure 2:
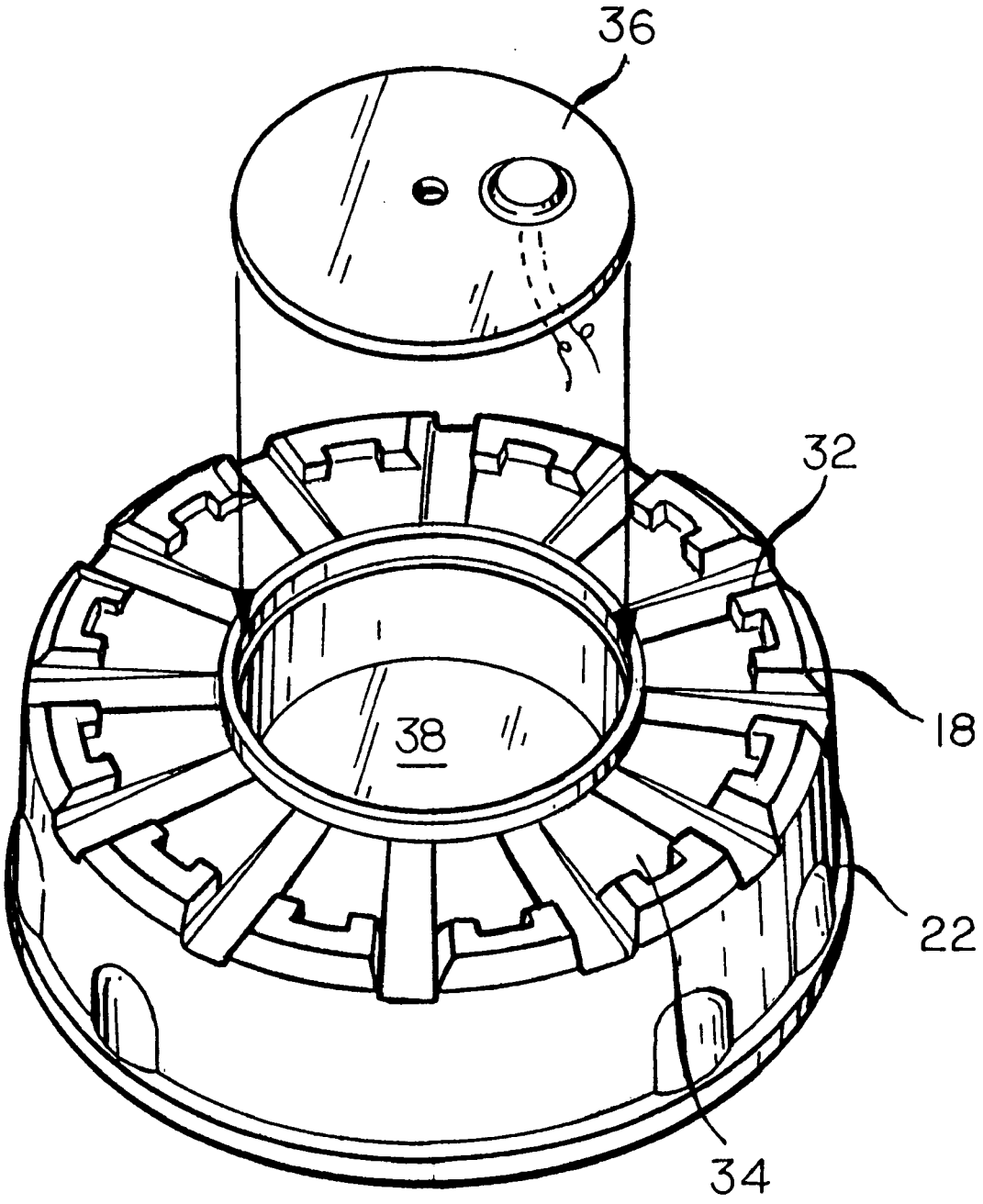
FIG. 2 is an exploded perspective view of an element of the closure of the package of FIG. 1.

A package according to the preferred embodiment of the present invention is identified generally by reference numeral 10 in FIG. 1, and the package 10 is made up of a bottle or other container 12 with a closure 14 removably secured to the container 12, and particularly to the exterior of an annular finish portion 16 of the container 12. The closure 14 is of two-piece construction having child resistant opening characteristics, and has an inner closure member 18 directly secured to the exterior of the finish 16 of the container 12 and an outer closure member 20 overlying and surrounding the inner closure member 18. In that regard, the inner closure member 18, which has an annular skirt 22 as an integral part thereof, is provided with an inwardly projecting helical thread 24 on the inside of the annular skirt 22, and the helical thread 24 of the inner closure member 18 engages a complemental outwardly projecting helical thread 26 on the outside of the finish 16 of the container 12, to permit the closure 14 to be rapidly applied to, and removed from, the container 12. Of course, it is also contemplated that the closing relationship between the closure 14 and the container 12 can be obtained in other known ways, for example, by a bayonet type connection therebetween. In any case, the container 12 may be produced from glass or any of a wide variety of suitable thermoplastic materials, in any known, conventional manner, and each of the inner container member 18 and the outer container member 20 of the closure 14 is preferably produced by injection molding from a suitable thermoplastic material, such as high density polyethylene or polypropylene.

Child resistant opening features of the closure 14 are obtained by providing a plurality of circumferentially spaced downwardly depending radial ribs 28 on an underside of an integral top panel portion 30 of the outer closure member 20 and a corresponding plurality of circumferentially spaced upwardly facing radial recesses 32 in an upper side of an integral panel portion 34 of the inner closure member 18, the recesses 32 being in an outer annular portion of the top panel 32 for reasons that will be hereinafter described more fully. In the normal orientation of the outer closure member 20 and the inner closure member 18, as shown in FIG. 1, the ribs 28 do not mesh with the recesses 32, the outer closure member being upwardly biased with respect to the inner closure by means (not shown); in this orientation, therefore, turning of the outer closure member 20 with respect to the container 12 will not be effective to unscrew the inner closure member 18 from the container 12. However, when the outer closure member 20 is manually depressed with respect to the inner closure member 18, the ribs 28 will engage the recesses 32, and turning of the outer closure member 20 with respect to the container 12 will be effective to remove by unscrewing the entire closure 14 from the container 12.

To emit a message or other audible signal upon the removal of the closure 14 from the container 12, an electrical element 36, for example, of a type used in "talking" greeting cards, is trapped between the inner closure member 18 and the outer closure member 20, and specifically in an upper portion of a depressed central region 38 of the top panel 34 of the inner closure member 18. The electrical element 36 is normally silent, but emits an audible message or signal upon its distortion, and in the package 10 this will occur when the outer closure member 20 is depressed with respect to the inner closure member 18 upon the start of the removal of the closure 14 from the container 12, as described above. In that regard, a small battery 40 to power the electrical element 36 is contained within a lower portion of the depressed central portion 38 that underlies the electrical element 36. The electrical element 36 can be programmed to emit a message that contains instructions for use of the product packaged in the package 10 or any other message relating to the packaged product, it can be programmed to provide a message of appreciation to the consumer for purchasing the product, or it can be used to provide information regarding related products. It can also be used simply to broadcast an audible noise to provide an indication that the package is being opened.

Although the best mode contemplated by the inventor for carrying out the present invention as of the filing date hereof has been shown and described herein, it will be apparent to those skilled in the art that suitable modifications, variations and equivalents may be made without departing from the scope of the invention, such scope being limited solely by the terms of the following claims and the legal equivalents thereof.

What is claimed is:

1. A talking closure for application to a container, said closure comprising:

a top panel;

an annular skirt extending downwardly from said top panel and carrying a means for releasably securing said closure to a neck of the container; and a normally silent electrical element carried by said closure, said electrical element being adapted to emit an audible signal upon application of a load to said closure;

wherein said means for releasably securing said closure to a neck of the container comprises an inner closure member having a second top panel underlying said top panel, said inner closure member having a second annular skirt, said second annular skirt being adapted to directly contact an exterior of said neck of said container; and wherein said electrical element is positioned between one of said top panel and said annular skirt and one of said second top panel and said second annular skirt and is adapted to emit the audible signal upon application of an opening load to said closure by distortion of said one of said top panel and said annular skirt by the opening load.

2. A talking closure according to claim 1 wherein said electrical element is trapped between said inner closure member and said top panel of said closure.

3. A talking closure for removable application to a container, said talking closure comprising:

an outer closure member, said outer closure member having a top panel and an annular skirt extending downwardly from said top panel;

an inner closure member having a second top panel that underlies said top panel of said outer closure member and a second annular skirt extending downwardly from said second top panel and being surrounded by said annular skirt of said outer closure member, said second annular skirt having means for releasably securing said inner closure member to a neck of the container; and a normally silent electrical element carried by said inner closure member and positioned between one of said top panel and said annular skirt of said outer closure member and one of said second top panel and said second annular skirt of said inner closure member, said electrical element being adapted to emit an audible signal upon application of a removal load to said one of said top panel and said annular skirt of said outer closure member.

4. A talking closure according to claim 3 wherein each of said outer closure member and said inner closure member carry normally disengaged means for preventing turning of said outer closure member with respect to the container from removing said inner closure member from the container unless and until said outer closure member is manipulated with respect to said inner closure member to engage said normally disengaged means.

5. A talking closure according to claim 4 wherein said normally disengaged means comprises a circumferential plurality of ribs on one of said top panel of said outer closure member and said second top panel of said inner closure member and extending to the other of said outer closure member and said inner closure member, and a circumferential plurality of recesses on the other of said top panel of said outer closure member and said second top panel of said inner closure member and facing toward said one of said outer closure member and said inner closure member, said ribs and said recesses being engagable upon application of a load against said top panel of said outer closure member.

6. A talking closure according to claim 3 wherein said each of said inner closure member and outer closure member is formed in a single piece from a thermoplastic material by injection molding.

7. A package comprising:

a container;

a closure removably affixed to said container, said closure comprising;

an outer closure member, said outer closure member having a top panel and an annular skirt extending downwardly from said top panel, an inner closure member having a second top panel that underlies said top panel of said outer closure member and a second annular skirt extending downwardly from said second top panel and being surrounded by said annular skirt of said outer closure member, said second annular skirt having means for releasably securing said inner closure member to a neck of the container; and a normally silent electrical element carried by said inner closure member and positioned between one of said top panel of said outer closure member and said annular skirt of said outer closure member and said inner closure member, said electrical element being adapted to emit an audible signal upon application of a removal load to said outer closure member.

8. A package according to claim 7 wherein each of said outer closure member and said inner closure member of said closure carry normally disengaged means for preventing turning of said outer closure member with respect to the container from removing said inner closure member from the container unless and until said outer closure member is manipulated with respect to said inner closure member to engage said normally disengaged means.

9. A package according to claim 8 wherein said normally disengaged means comprises a circumferential plurality of ribs on one of said top panel of said outer closure member and said second top panel of said inner closure member and extending toward the other of said outer closure member and said inner closure member and a circumferential plurality of recesses on the other of said top panel of said outer closure member and said second top panel of said inner closure member and facing toward said one of said outer closure member and said inner closure member, said ribs and said recesses being engagable upon application of a load against said top panel of said outer closure member.

10. A package according to claim 9 wherein said circumferential plurality of ribs extends from said top panel of said outer closure member toward said second top panel of said inner closure member.

11. A package according to claim 7 wherein each of said inner closure member and said outer closure member is formed from a thermoplastic material by injection molding.

* * * * *